US005511677A

United States Patent [19]

Oder

[11] Patent Number: 5,511,677

[45] Date of Patent: Apr. 30, 1996

[54] CONTAINER HAVING A TAMPER EVIDENCY SYSTEM

[75] Inventor: Reuben E. Oder, Union, Ky.

[73] Assignee: The Procter & Gamble Company, Cincinnati, Ohio

[21] Appl. No.: 413,664

[22] Filed: Mar. 30, 1995

[51] Int. Cl.[6] ..... B65D 41/34

[52] U.S. Cl. ..... 215/252; 215/230

[58] Field of Search ..... 215/252, 230, 215/330

[56] References Cited

U.S. PATENT DOCUMENTS

| | | | |
|---|---|---|---|
| 1,739,434 | 12/1929 | Young | 215/252 |
| 2,092,547 | 9/1937 | Allenbaugh | 215/252 |
| 2,414,420 | 1/1947 | Sebell | 215/252 |
| 3,685,677 | 8/1972 | Westfall . | |
| 3,888,383 | 6/1975 | Rowlands . | |
| 4,197,955 | 4/1980 | Luenser . | |
| 4,289,248 | 9/1981 | Lynn . | |
| 4,401,227 | 8/1983 | Pehr | 215/252 |
| 4,458,820 | 7/1984 | Abrams . | |
| 4,519,515 | 5/1985 | Schonberger . | |
| 4,569,456 | 2/1986 | Weiler et al. . | |
| 4,646,926 | 3/1987 | Agbay et al. . | |
| 4,699,124 | 5/1987 | Kimura . | |
| 4,711,372 | 12/1987 | Gach . | |
| 4,726,482 | 2/1988 | Barriac | 215/252 |
| 4,759,456 | 7/1988 | Kusz | 215/252 |
| 4,844,272 | 7/1989 | Dutt . | |
| 4,986,430 | 1/1991 | Dutt . | |
| 5,105,960 | 4/1992 | Crisci . | |
| 5,133,471 | 7/1992 | Pujol Almirall . | |
| 5,292,020 | 3/1994 | Narin . | |
| 5,351,845 | 10/1994 | Hunter . | |

FOREIGN PATENT DOCUMENTS

| | | | |
|---|---|---|---|
| 2605703 | 8/1977 | Germany | 215/252 |

*Primary Examiner*—Stephen K. Cronin
*Attorney, Agent, or Firm*—Ronald W. Kock

[57] ABSTRACT

A tamper evidency system for a container having a closed body, an open ended finish portion, and a closure to close the open end of the finish portion. The closure has a top and a depending wall portion which has cam teeth extending inward toward the finish portion. A lug extends from the outer surface of the finish portion, located between the finish portion and the cam teeth when the closure installed. The lug is integrally molded to the finish portion by a shearable web. The shearable web has an orientation, which enables the lug to be rotated about the shearable web by the cam teeth without interfering with installation when the closure is installed onto the finish portion. The lug also engages one of the cam teeth when the closure is removed from the finish portion. The lug prevents the closure from being removed without first shearing the lug from the finish portion at the shearable web. The lug is unreachable for manipulation without the use of tools. In addition, the lug has a corner which contacts the outer surface of the finish portion when one of the cam teeth rotates the lug in a closure removal direction. The lug pivots about the corner upon contact with the finish portion to create a mechanical advantage for shearing the lug from the finish portion at the shearable web. The tamper evidency system may further comprise a flag extending from the lug outside the open end of the closure in order to be visible to a consumer before the lug has been sheared off. Alternatively a lug and shearable web are integrally molded with a closure, and engaging cam teeth are formed on a container finish.

11 Claims, 2 Drawing Sheets

CONTAINER HAVING A TAMPER EVIDENCY SYSTEM

FIELD OF THE INVENTION

The present invention relates to a tamper evidency system for a container having a removable closure, and more particularly to such a system wherein a member is broken off either the container or the closure the fast time the closure is removed in order to signal a purchaser whether or not the closure has been removed prior to sale. Even more particularly, the present invention relates to a tamper evidency member which is integrally molded with either the container or the closure.

BACKGROUND OF THE INVENTION

Prior art discloses several tamper evidency systems for containers having snap-on closures and threaded closures. For example, U.S. Pat. No. 4,646,926 to Abgay et al. shows a container finish having a lug supported by a web which extends radially outward from the finish. The lug is ramped relative to a horizontal plane. A threaded closure has saw teeth around its lowermost edge which push downward on the lug ramp when the closure is installed. A vertical edge of a saw tooth engages a vertical edge of the lug when the closure is unscrewed. Unscrewing cannot occur without shearing off the lug. Since the lug is visible and accessible below the closure, the consumer can determine if it is missing, indicating potential tampering. Unfortunately, when a tamper evidency feature such as Abgay et al.'s lug is accessible, it is also capable of being manually overridden. Therefore, it is unreliable as a tamper evidency system.

U.S. Pat. No. 4,669,124 to Kimura discloses a threaded closure which has outwardly extending saw teeth. A frangible engagement member is located outside the closure. The arrangement is like a ratchet and pawl. The frangible member bends radially outward as the saw teeth pass it when the closure is installed. Upon unscrewing the closure, the frangible member is pushed circumferentially and it is sheared off. As with Abgay et al. the external location of the frangible member allows it to be manually bent to avoid the shearing forces. Thus, Kimura also fails to provide a reliable tamper evidency system.

U.S. Pat. No. 3,888,383 to Rowlands discloses a container having a threaded closure which has a radially inward projecting tooth. When the closure is installed, the tooth cams downward a pull tab, attached to the container finish, to where the pull tab is visible and accessible. The tooth then passes the pull tab. Upon attempting to unscrew the closure, the tooth engages the pull tab and prevents the closure from being unscrewed. The pull tab must first be manually ripped off the container finish before the closure can be opened. This system cannot be easily overridden and is therefore reliable. However, the need to grip a pull tab and pull it off may be difficult for some users, especially the elderly with arthritis.

Tamper evidency members, such as the pull tab of Rowlands, which are molded integrally with plastic containers, are often difficult to remove. The size of the connection to the container is directly related to the rate of plastic flow to the member which is intended to be pulled or twisted or otherwise sheared off at the connection point. A very small connection point which is easy to shear may require excessive time to form in a molding system. A large connection may be rapidly molded but require excessive force to remove from the container.

There is a need for a tamper evidency system which enables the user to grip the closure in order to remove the tamper evidency member, yet have a member which is not readily accessible so that the reliability of the system is preserved.

There is also a need to provide a leverage means for reducing the force to remove a tamper evidency member which has been integrally molded either with a container or a closure.

SUMMARY OF THE INVENTION

In practicing the present invention, a tamper evidency system may be integrally molded with a container which is injection molded, injection blow molded, or extrusion blow molded, and which has a closure which is screw-on, snap-on, or a combination thereof. Alternatively, a tamper evidency system may be integrally molded with an injection molded closure which is screw-on, snap-on, or a combination thereof.

In one aspect of the present invention a tamper evidency system comprises a container having a closed body and a finish portion, the finish portion having an outer surface and an open end. It also comprises a closure having a top, a wall portion depending from the top, and an open end opposite the top. The wall portion is adapted to engage the finish portion of the container in order to close the open end of the finish portion. The wall portion has cam teeth extending inward toward the finish portion. The tamper evidency system also comprises a lug extending from the outer surface of the finish portion and located between the finish portion and the cam teeth of the wall portion of the closure when the closure is installed. The lug is connected to the finish portion by a shearable web. The lug has a shape, and the shearable web has an orientation, which together enable the lug to be rotated about the shearable web by the cam teeth without interfering with installation when the closure is installed onto the finish portion. The lug also has a shape which engages one of the cam teeth when the closure is removed from the finish portion, the lug preventing the closure from being removed without first shearing the lug from the finish portion at the shearable web. The lug is unreachable for manipulation without the use of tools in order to avoid engagement of the lug with one of the cam teeth, thereby bypassing the tamper evidency feature. In addition, the lug has a corner which contacts the outer surface of the finish portion when the one of the cam rotates the lug in a closure removal direction. The lug pivots about the corner upon contact with the finish portion to create a mechanical advantage for shearing the lug from the finish portion at the shearable web. The tamper evidency system may further comprise a flag extending from the lug outside the open end of the closure in order to be visible to a consumer before the lug has been sheared off.

Alternatively a lug and shearable web are integrally molded with a closure, and engaging cam teeth are formed on a container finish. The lug has a corner which contacts the inner surface of the wall portion when the one of the cam teeth rotates the lug in a direction opposite to closure removal direction. The lug pivots about the corner upon contact with the wall portion to create a mechanical advantage for shearing the lug from the wall portion at the shearable web.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
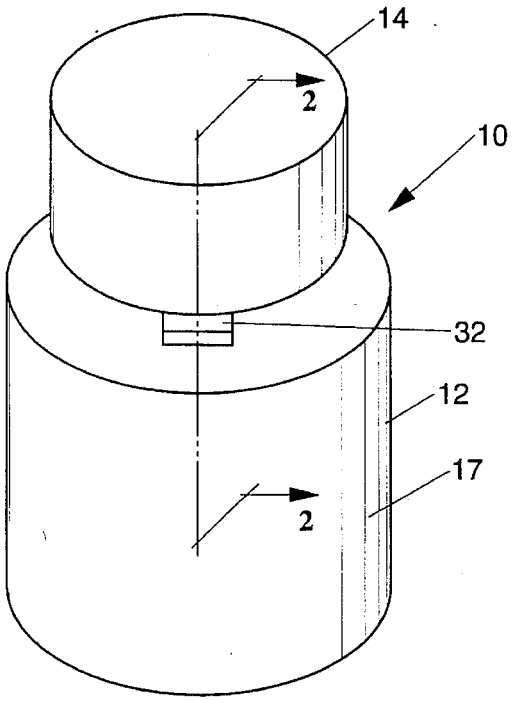
FIG. 1 is a perspective view of a preferred embodiment of the tamper evidency system of the present invention, disclosing a closure and a container with a visible flag located therebetween.
Figure 2:
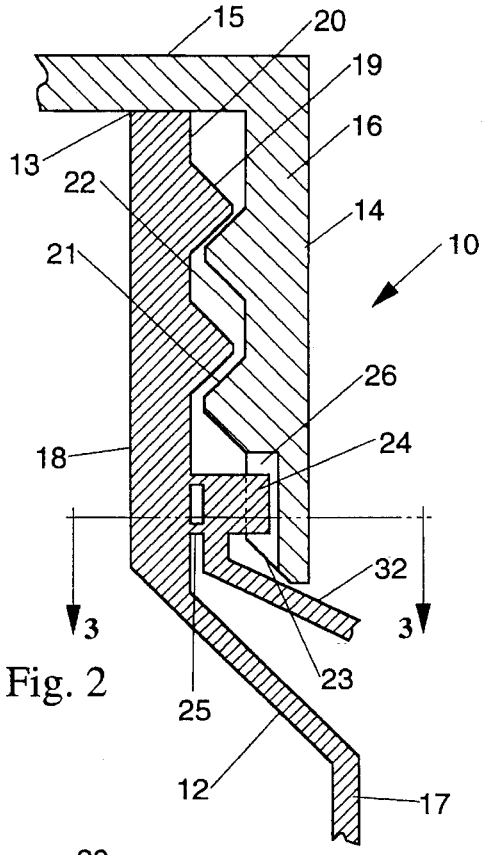
FIG. 2 is a sectioned partial side elevation view thereof, taken along section line 2—2 of FIG. 1, showing an integrally molded lug connected to the finish of the container at two places, and a flag extending outward from just under the closure.

Referring now to the drawings, and more particularly to FIGS. 1 and 2, there is shown a first preferred embodiment of the present invention, which provides a tamper evidency system, and is generally indicated as 10. Tamper evidency system 10 is intended for a container 12, such as a bottle, having an open end 13 which is closed by a closure 14, such as a screw-on cap. Closure 14 has a top 15 and a preferably continuous cylindrical depending side wall portion 16. Container 10 typically has a body 17 and a finish portion 18, which surrounds open end 13. Finish portion 18 may have threads 19 on its outer surface 20, as shown in FIG. 2, which mate with threads 21 on an inner surface 22 of wall portion 16 for attaching closure 14.

A closure which snaps onto other surfaces of the container finish for installation, and which snaps off or unscrews for removal, may also utilize the tamper evidency system of the present invention. Such closures may not have a continuous side wall portion and/or engagement features may be interrupted. It is key that there be substantial linear or rotational motion associated with the removal of the closure in order for tamper evidency system 10 of the present invention to function.

Closure 14 also has an open end 23 opposite top 15 into which finish portion 18 fits, but which is typically somewhat larger in diameter than finish portion 18 to account for threads 19 and 21. Between inner surface 22 of wall portion 16 and outer surface 20 of finish portion 18 is an annular space which may be adapted to receive tamper evidency system 10. Tamper evidency system 10 comprises a lug 24, which is preferably connected to outer surface 20 by a shearable web 25, which extends radially from finish portion 18. Shearable web 25 enables lug 24 to rotate about it in a plane parallel to the direction of removal of closure 14. That is, if closure 14 is a screw-on cap, shearable web 25 is oriented axially with finish portion 18 because the closure removal direction is circumferential. However, if closure 14 is a snap-on cap, shearable web 25 is oriented perpendicular to the axis of finish portion 18 because the closure removal direction is axial.

Shearable web 25 is preferably two molding gates so that lug 24 may be molded integrally with container 12. The two molding gates 25 are spaced apart as shown in FIG. 2. The molding gates and lug 24 are located just inside open end 23 of closure 14. Closure 14 has inwardly directed cam teeth 26 circumferentially spaced around inner surface 22.

Figure 3:
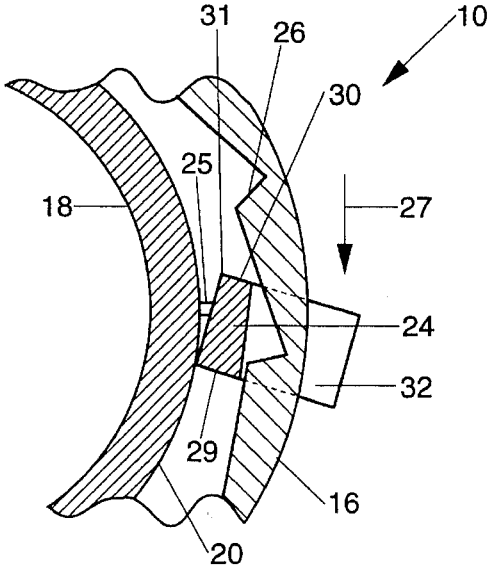
FIG. 3 is a sectioned partial plan view thereof, taken along section line 3—3 of FIG. 2, showing the lug pushed about its connection point in the direction of the rotation of the closure as the closure is threaded onto the container finish, the closure teeth being unhindered by the presence of the lug.
Figure 4:
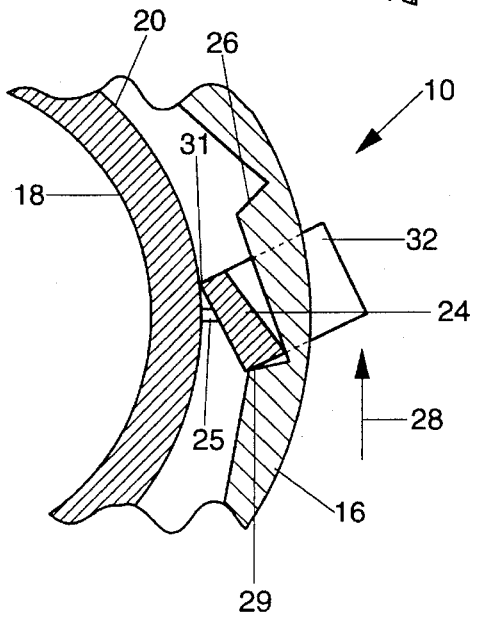
FIG. 4 is a sectioned partial plan view thereof, similar to FIG. 3, but showing the lug rotated about its connection point in the direction of unscrewing the closure. In this condition the teeth of the closure engage the lug and force it against the container finish. The contact point with the finish acts as a fulcrum point such that further rotation of the lug provides leverage about the fulcrum point to enable shearing off the lug with reduced closure torque.

Cam teeth 26 are best seen in FIGS. 3 and 4. They are ramped gently in a direction of closure installation 27 so that installation is not hindered by the presence of lug 24. However, cam teeth 26 are ramped sharply in a direction of closure removal 28, so that one tooth 26 will engage lug 24 upon the initiation of closure removal. When the closure is threaded onto the container, the cam teeth merely push the lug to one side in direction of threading 27. When the closure is unscrewed in direction 28, a cam tooth 26 engages lug 24 and pushes it in the direction of unscrewing.

FIGS. 3 and 4 show that the shape of lug 24 and the location of shearable web 25 is such that a tooth engaging end 29 of lug 24 is about twice as far from shearable web 25 as is a fulcrum end 30. Fulcrum end 30 has a corner 31. When closure 14 is unscrewed and lug 24 is pushed in the direction of unscrewing, corner 31 eventually contacts outer surface 20 of finish portion 18. Further rotation of lug 24 about shearable web 25 causes corner 31 to behave as a fulcrum point. That is, rotation occurs about corner 31 while shearable web 25 is bent or distorted. Some distortion of wall portion 16 may also occur to accommodate the rotation of lug 24. Eventually, further rotation of lug 24 about corner 31 causes lug 24 to separate at shearable web 25. It is believed that the separation is a shearing failure, although it may also involve tensile failure. In any case, lug 24 separates from container 12 before closure 14 is fully released from container 12.

Molding gates 25 must be sufficiently large to enable filling the lug cavity of the mold in a short time. They must also be robust enough to enable the lug to survive mold ejection and packing line handling before the closure is installed. Containers are typically made of tough high density polyethylene (HDPE). Therefore, a large gate is difficult to shear off by hand twisting a closure. An important aspect of the shape of lug 24 is the leverage gained by having shearable molding gate 25 closer to corner 31 than to tooth engaging end 29. When the distance from engagement end 29 to molding gate 25 is twice the distance from tool molding gate 25 to corner 31, a leverage factor of 3 results. This either enables the lug to be sheared with lower applied closure torque, or it enables the mold gates to be larger.

All drawing figures show a tab 32 extending from lug 24 to outside open end 23 of closure 14, so that tab 32 is visible. Tab 32 is a "flag" which indicates to the purchaser of the container that the tamper evidency system is still in place. Thus, the purchaser can be confident that no one has opened the closure and tampered with the contents of the container prior to purchase. If the closure has been unscrewed, the lug will have been broken off the finish portion and the lug and flag will have fallen away from the container. By absence of the flag, the user will be warned of possible closure tampering. The lug and molding gates are tucked sufficiently inside the closure that they are not accessible for manipulation to override the tamper evidency system. Although the flag may be manipulated, it is not obvious what manipulation will enable overriding the tamper evidency system. The shape of the lug may even be adjusted so that there is always some interference with the cam teeth in order to ensure that no flag manipulation can possibly override the tamper evidency system.

Figure 5:
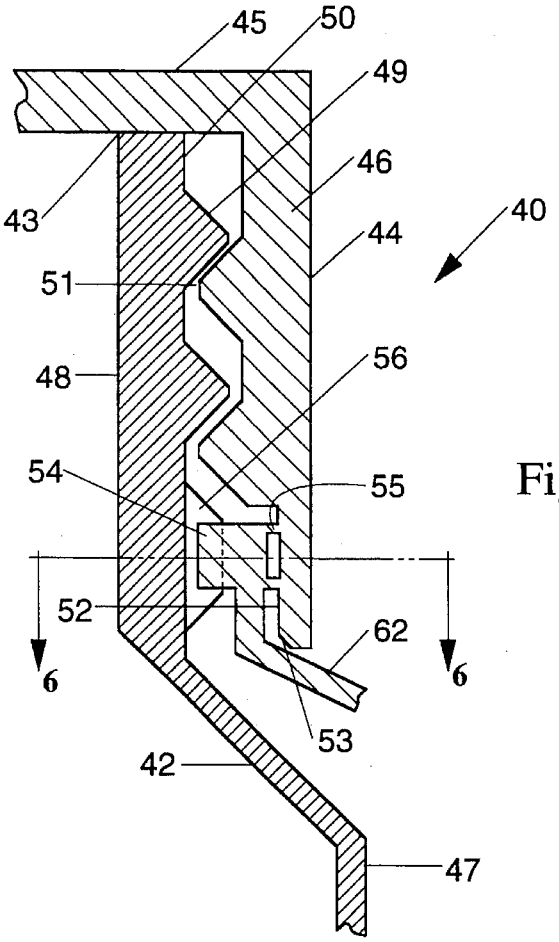
FIG. 5 is a sectioned partial side elevation view of an alternative embodiment of the tamper evidency system of the present invention, similar to FIG. 2, but showing an integrally molded lug connected to a closure, and a flag extending outward from just under the closure.
Figure 6:
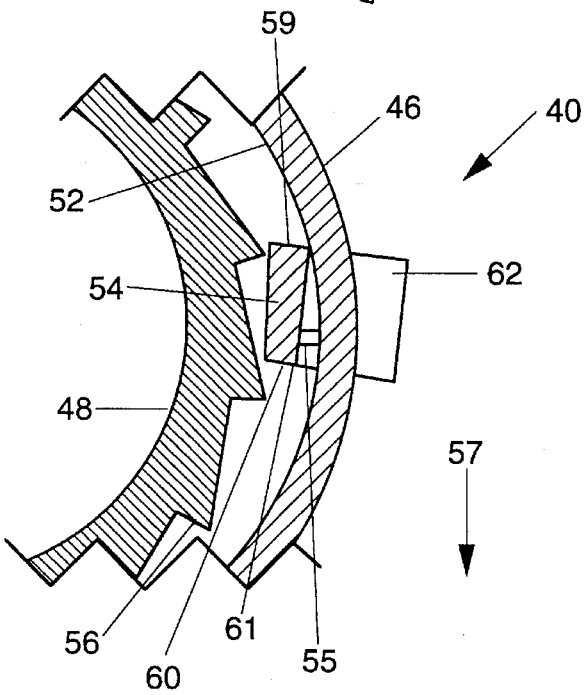
FIG. 6 is a sectioned partial plan view thereof, taken along section line 6—6 of FIG. 5, showing the lug pushed about its connection point in the direction opposite the rotation of the closure as the closure is threaded onto the collar finish, the lug being unhindered by the presence of the cam teeth on the closure.
Figure 7:
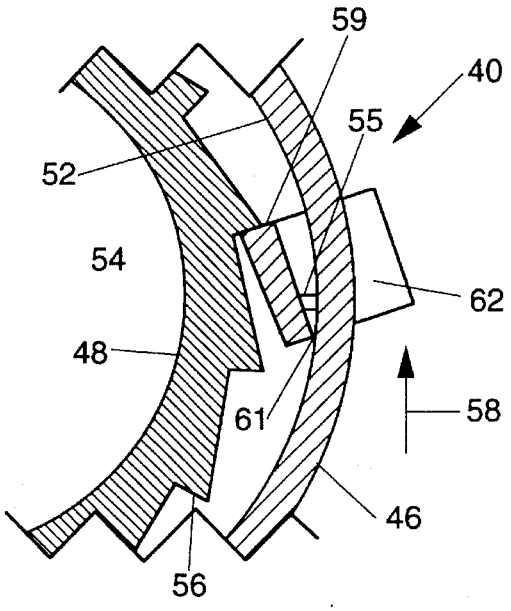
FIG. 7 is a sectioned partial plan view thereof, similar to FIG. 6, but showing the lug rotated about its connection point in the direction opposite unscrewing the closure. In this condition the teeth of the container finish engage the lug and force it against the inner wall of the closure. The contact point with the inner wall acts as a fulcrum point such that further rotation of the lug provides leverage about the fulcrum point to enable shearing off the lug with reduced closure torque.

An alternative to the above-described embodiment of the present invention is shown in FIGS. 5, 6, and 7. In the alternative embodiment a tamper evidency system is generally indicated as 40. The alternative includes a similar container and closure except that the cam teeth are molded as part of the container and the lug and shearable web are molded as part of the closure.

Tamper evidency system 40 is intended for a container 42, such as a bottle, having an open end 43 which is closed by a closure 44, such as a screw-on cap. Closure 44 has a top 45 and a preferably continuous cylindrical depending side wall portion 46. Container 40 typically bas a body 47 and a finish portion 48, which surrounds open end 43. Finish portion 48 may have threads 49 on its outer surface 50, as shown in FIG. 5, which mate with threads 51 on an inner surface 52 of wall portion 46 for attaching closure 44.

Closure 44 also has an open end 53 opposite top 45 into which finish portion 48 fits, but which is typically somewhat larger in diameter than finish portion 48 to account for threads 49 and 51. Between inner surface 52 of wall portion 46 and outer surface 50 of finish portion 48 is an annular space which may be adapted to receive tamper evidency system 40. Tamper evidency system 40 comprises a lug 54, which is preferably connected to inner surface 52 by a shearable web 55, which extends radially inward from wall portion 46. Shearable web 55 enables lug 54 to rotate about it in a plane parallel to the direction of removal of closure 44. That is, if closure 44 is a screw-on cap, shearable web 55 is oriented axially with wall portion 46 because the closure removal direction is circumferential. However, if closure 44 is a snap-on cap, shearable web 55 is oriented perpendicular to the axis of wall portion 46 because the closure removal direction is axial.

Shearable web 55 is preferably two molding gates so that lug 54 may be molded integrally with closure 44. The two molding gates 55 are spaced apart as shown in FIG. 5. The molding gates and lug 54 are located just inside open end 53 of closure 44. Container 42 has outwardly directed cam teeth 56 circumferentially spaced around outer surface 50 of finish portion 48.

Cam teeth 56 are best seen in FIGS. 6 and 7. They are ramped gently in a direction of closure installation 57 so that installation is not hindered by the presence of lug 54. However, cam teeth 56 are ramped sharply in a direction of closure removal 58, so that one tooth 56 will engage lug 54 upon the initiation of closure removal. When the closure is threaded onto the container, the cam teeth merely push the lug to one side. When the closure is unscrewed in direction 58, a cam tooth 56 engages lug 54 and pushes it opposite the direction of unscrewing.

FIGS. 6 an 7 show that the shape of lug 54 and the location of shearable web 55 is such that a tooth engaging end 59 of lug 54 is about twice as far from shearable web 55 as is a fulcrum end 60. Fulcrum end 60 has a corner 61. When closure 44 is unscrewed and lug 54 is pushed opposite the direction of unscrewing, corner 61 eventually contacts inner surface 52 of wall portion portion 46. Further rotation of lug 54 about shearable web 55 causes corner 61 to behave as a fulcrum point. That is, rotation occurs about corner 61 while shearable web is bent or distorted. Some distortion of wall portion 46 may also occur to accommodate the rotation of lug 54. Eventually, further rotation of lug 54 about corner 61 causes lug 54 to separate at shearable web 55. It is believed that the separation is a shearing failure, although it may also involve tensile failure. In any case, lug 54 separates from closure 44 before closure 44 is fully released from container 42.

FIGS. 5, 6, and 7 show a tab 62 extending from lug 54 to outside open end 53 of closure 44, so that tab 62 is visible. Tab 62 is a "flag" which indicates to the purchaser of the container that the tamper evidency system is still in place.

In a particularly preferred embodiment of the present invention, container 12, which is made of HDPE, has a finish portion 18 having an outer surface 20 which has a diameter of 42.3 mm. Closure 14, which is made of polypropylene, has a wall portion 16 having an inner surface 22, which has a diameter of 45.4 mm. The differences in diameters provides an annular space between closure and container finish 1.05 mm wide all around the finish. Within this space is located lug 24, having a length of 4.55 mm from end 29 to end 30. Lug 24 is connected to finish portion 18 by two molding gates 25, each of which has a diameter of 0.3 mm and length of 0.38 mm. Lug 24 has a maximum width at its connection to molding gates 25 of 2.21 mm.

Closure 14 has cam teeth 26 on inner surface 22 recessed 1.54 mm into wall portion 16 to engage lug 24. There are 24 cam teeth around the inner circumference of closure 14.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A tamper evidency system comprising:

a) a container having a body and a finish portion, said finish portion having an outer surface and an open end;

b) a closure having a top, a wall portion depending from said top, and an open end opposite said top, said wall portion adapted to engage said finish portion of said container in order to close said open end of said finish portion, said wall portion having cam teeth extending inward toward said finish portion; and c) a lug extending from said outer surface of said finish portion and located between said finish portion and said cam teeth of said wall portion of said closure when said closure is installed, said lug being connected to said finish portion by a shearable web, said shearable web having an orientation which enables said lug to be rotated about said shearable web by said cam teeth without interfering with installation when said closure is installed onto said finish portion, said lug engaging one of said cam teeth when said closure is removed from said finish portion, said lug preventing said closure from being removed without first shearing said lug from said finish portion at said shearable web, said lug having a corner which contacts said outer surface of said finish portion when said one of said cam teeth rotates said lug in a closure removal direction, said lug pivoting about said corner upon contact with said finish portion to create a mechanical advantage for shearing said lug from said finish portion at said shearable web.

2. The tamper evidency system of claim 1 wherein said lug is unreachable for manipulation without the use of tools in order to avoid engagement of said lug with said one of said cam teeth.

3. The tamper evidency system of claim 1 further comprising a flag extending from said lug outside said open end of said closure in order to be visible to a consumer before said lug has been sheared off.

4. The tamper evidency system of claim 1 wherein said lug and said shearable web are integrally molded with said container.

5. A tamper evidency system comprising:

a) a container having a body and a finish portion, said finish portion having an outer surface and an open end, said outer surface having finish threads;

b) a closure having a top, a cylindrical wall portion depending from said top, and an open end opposite said top, said wall portion having closure threads adapted to engage said finish threads in order to close said open end of said finish portion when said closure is screwed onto said finish portion, said wall portion having cam teeth extending inward toward said finish portion; and c) a lug integrally molded with said container, said lug extending from said outer surface of said finish portion and located between said finish portion and said cam teeth of said wall portion of said closure when said closure is screwed onto said finish portion, said lug being connected to said finish portion by an axially oriented shearable web, which enables said lug to be rotated about said shearable web without interfering with screwing said closure onto said finish, said lug engaging one of said cam teeth when said closure is unscrewed from said finish portion, said lug preventing said closure from being unscrewed without first shearing said lug from said finish portion at said shearable web, said lug having a corner which contacts said outer surface of said finish portion when said one of said cam teeth rotates said lug in a closure unscrewing direction, said lug pivoting about said corner upon contact with said finish portion to create a mechanical advantage for shearing said lug from said finish portion at said shearable web.

6. The tamper evidency system of claim 5 wherein said lug is unreachable for manipulation without the use of tools in order to avoid engagement of said lug with said one of said cam teeth.

7. The tamper evidency system of claim 5 further comprising a flag extending from said lug outside said open end of said closure in order to be visible to a consumer before said lug has been sheared off.

8. A tamper evidency system comprising:

a) a container having a body and a finish portion, said finish portion having an outer surface and an open end, said outer surface having cam teeth extending outward;

b) a closure having a top, a wall portion depending from said top, and an open end opposite said top, said wall portion adapted to engage said finish portion of said container in order to close said open end of said finish portion; and c) a lug extending inward from said wall portion of said closure and located between said wall portion and said cam teeth of said finish portion when said closure is installed, said lug being connected to said wall portion by a shearable web, said shearable web having an orientation which enables said lug to be rotated about said shearable web by said cam teeth without interfering with installation when said closure is installed onto said finish portion, said lug engaging one of said cam teeth when said closure is removed from said finish portion, said lug preventing said closure from being removed without first shearing said lug from said wall portion at said shearable web, said lug having a corner which contacts said inner surface of said wall portion when said one of said cam teeth rotates said lug in a direction opposite to closure removal direction, said lug pivoting about said corner upon contact with said wall portion to create a mechanical advantage for shearing said lug from said wall portion at said shearable web.

9. The tamper evidency system of claim 8 wherein said lug is unreachable for manipulation without the use of tools in order to avoid engagement of said lug with said one of said cam teeth.

10. The tamper evidency system of claim 8 further comprising a flag extending from said lug outside said open end of said closure in order to be visible to a consumer before said lug has been sheared off.

11. The tamper evidency system of claim 8 wherein said lug and said shearable web are integrally molded with said closure.

* * * * *